United States Patent [19]

Schweitzer et al.

[11] Patent Number: 4,787,828

[45] Date of Patent: Nov. 29, 1988

[54] POWER TRANSMISSION

[75] Inventors: Jean J. Schweitzer, Brandon; Howard J. Sculthorpe, Jackson, both of Miss.

[73] Assignee: Vickers, Incorporated, Troy, Mich.

[21] Appl. No.: 28,892

[22] Filed: Mar. 23, 1987

[51] Int. Cl.[4] ..... F04B 1/20; F04B 35/00

[52] U.S. Cl. ..... 417/271; 91/482

[58] Field of Search ..... 417/315, 271; 91/482

[56] References Cited

U.S. PATENT DOCUMENTS

| | | | |
|---|---|---|---|
| 1,908,612 | 5/1933 | Johnson | 417/315 |
| 2,453,128 | 11/1948 | Hautzenroeder | 417/315 |
| 2,847,938 | 8/1958 | Gondek | 417/315 |
| 3,627,451 | 12/1971 | Kouns | 417/271 |
| 4,478,557 | 10/1984 | Schott | 417/271 |

*Primary Examiner*—William L. Freeh

*Attorney, Agent, or Firm*—Barnes, Kisselle, Raisch, Choate, Whittemore & Hulbert

[57] ABSTRACT

A reversible power transmission unit comprising a housing and a cam block rotatably mounted in the housing and a pumping mechanism associated with opposed inclined surfaces of the cam block. A common shaft is rotatably mounted in the cam block and has its ends extending beyond the cam block. Each pumping mechanism includes a cylinder barrel mounted on the shaft for rotation with the shaft and having a plurality of cylinders with pistons slidable therein and operatively associated with a surface of the cam block. Each cylinder has a port opening to a valve plate provided with inlet and outlet ports in communication with inlet and outlet passages at each end of the housing. When one of the pumping mechanisms is operated as a motor, it drives the other pumping mechanism as a pump.

2 Claims, 4 Drawing Sheets

POWER TRANSMISSION

This invention relates to power transmission units.

BACKGROUND AND SUMMARY OF THE INVENTION

In aircraft and the like, it is common to have hydraulic circuits which are totally separated so that if one fails, the others will still function, thereby preventing total loss of control. It is also common to provide power transmission units which function to supply additional flow upon demand from one circuit to the other to maintain integrity of either circuit in the event that there is a malfunction therein, or an exceptionally high flow demand for a limited and known period of time.

Among the objectives of the present invention are to provide a power transmission unit wherein the transmission occurs readily and easily; which power transmission can be reversed; wherein there is substantially little net reaction torque; which have a lower weight; and wherein axial forces tend to cancel one another thereby facilitating construction.

In accordance with the invention, a power transmission unit comprises a housing and a cam block rotatable mounted in the housing and a pumping mechanism associated with opposed inclined surfaces of the cam block. A common shaft is rotatably mounted in the cam block and has its ends extending beyond the cam block. Each pumping mechanism includes a cylinder barrel mounted on the shaft for rotation with the shaft and having a plurality of cylinders with pistons slidable therein and operatively associated with a surface of the cam block. Each cylinder has a port opening to a valve plate provided with inlet and outlet ports in communication with inlet and outlet passages at each end of the housing. When one of the pumping mechanisms is operated as a motor, it drives the other pumping mechanism as a pump.

DESCRIPTION

Figure 1:
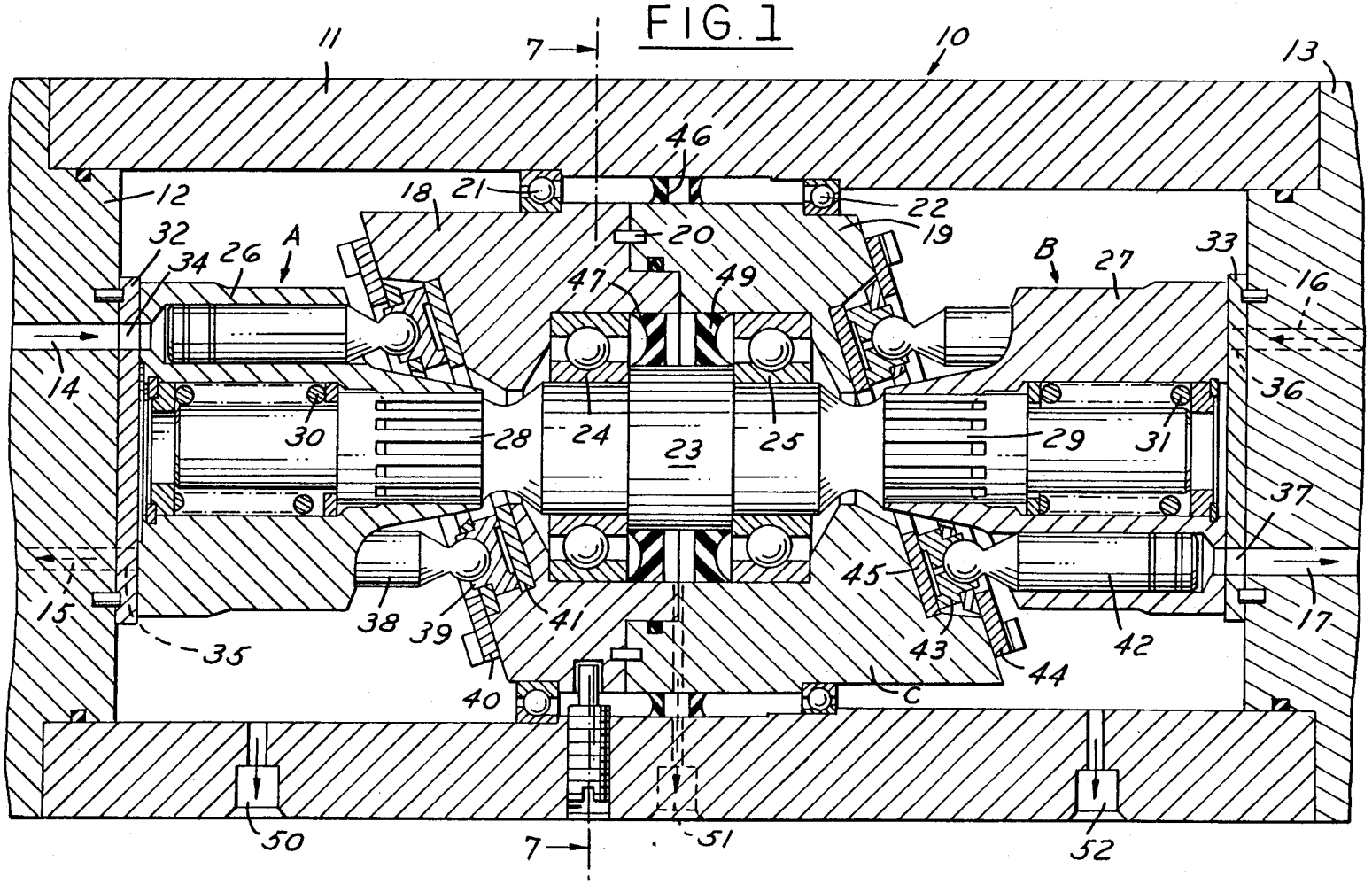
FIG. 1 is a fragmentary longitudinal sectional view of a power transmission unit embodying the invention.
Figure 2:
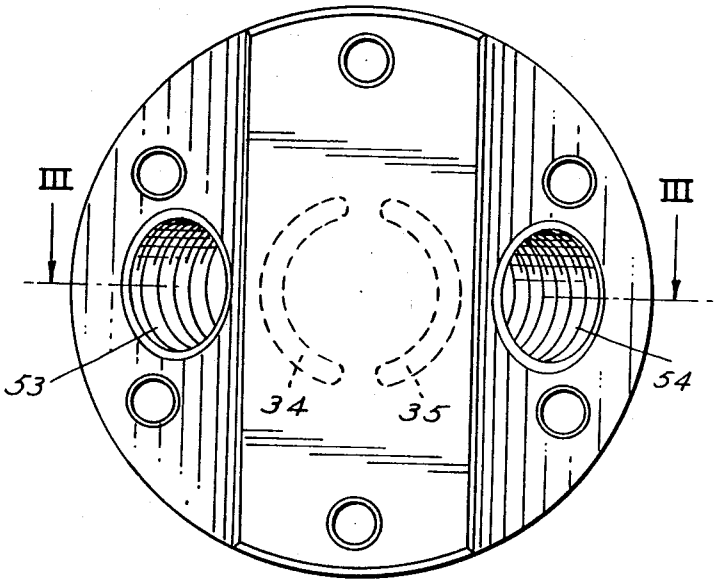
FIG. 2 is a fragmentary end view of one end of the power transmission unit.
Figure 3:
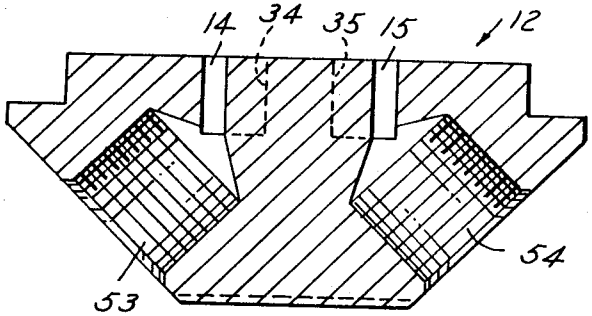
FIG. 3 is a sectional view taken along the line 3—3 in FIG. 2.

Referring to FIGS. 1-3, the power transmission unit embodying the invention comprises a housing 10 including a cylindrical side wall 11 and end members 12, 13 sealing the ends of the member 11. Pressure translating devices A, B in the form of barrel-type pumping mechanisms are associated with a common cam block C rotatably mounted within the housing 10.

End member 12 includes passages 14, 15 that may function as inlets or outlets. Similarly, end member 13 includes passages 16, 17 that may function as inlets or outlets. The cam block C includes two interconnected parts 18, 19 with one or more pins 20 holding the parts against relative rotation. The cam block C is rotatably mounted within the housing by axially spaced bearings 21, 22.

A shaft 23 is rotatably mounted within the cam block by bearings 24, 25 and the ends of the shaft 23 project beyond the cam block C for rotatably supporting the pumping mechanism A and B, respectively.

Each pumping mechanism is substantially identical in construction and comprises a barrel 26, 27 connected to the shaft 23 by a spline 28, 29 and yieldingly urged by a spring 30, 31 toward a valve plate 32, 33 fixed on the inner wall of the end members 12, 13, respectively. Each valve plate 32, 33 comprises a pair of arcuate passages 34, 35 and 36, 37 which communicate respectively with the passages 14, 15 and 16, 17.

Each pumping mechanism A, B further includes a plurality of circumferentially spaced pistons 38 operating in cylinders in the barrel and having their ends engaging shoes 39 which are maintained in contact by plate 40 on a shoe bearing plate 41. Similarly, the pumping assembly B includes pistons 42, shoes 43, a hold down plate 44 and a shoe bearing plate 45.

The pumping assemblies A, B are hydraulically isolated by spaced annular seals 46 between the wall 11 and cam block C and between the bearings 21, 22, and seals 47, 49 between the bearings 24, 25. Drain passages 50, 51, 52 are provided for draining fluid from the spaces about the pumping assemblies A and B as well as the spaces between the seals 46.

the passages 14 and 15 in the end members extend to respective exterior passages 53, 54 as shown, for example, in connection with the end member 12 in FIGS. 2 and 3.

When used as a power transfer unit with equal pressure differentials in A and B mechanisms, in order to equalize torques in both mechanisms A and B, the flow capacity of the motoring mechanism (e.g., A) must be set larger than the flow capacity of the pumping mechanism (e.g., B0 to compensate for losses generated in the unit.

If it is desired to use the unit as a pressure intensifer with A as the motor and B as the pump, the displacement in mechanism A is set larger than the displacement of mechanism B so that mechanism B will operate at a smaller displacement but at a higher pressure.

Figure 4:
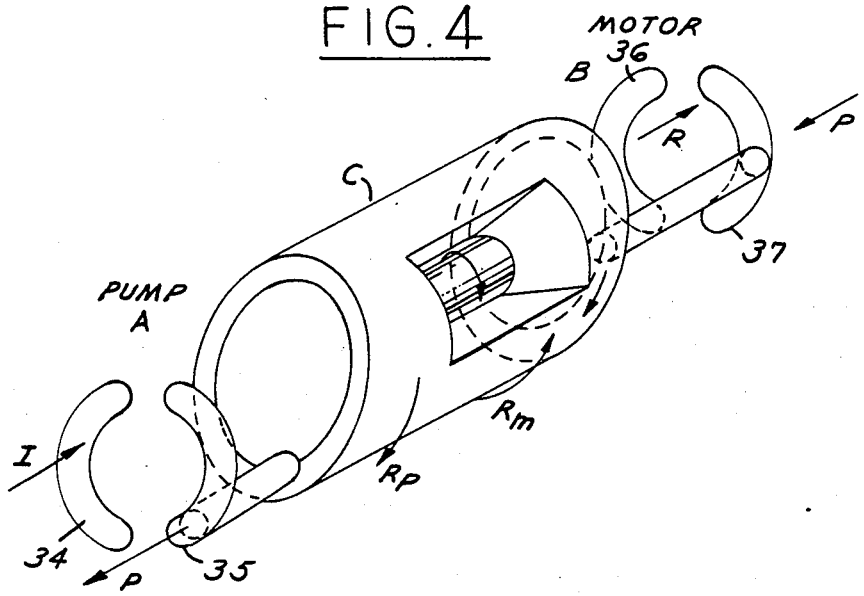
FIGS. 4 and 5 are schematic diagrams showing the functioning of the power transmission unit in reverse modes, respectively.
Figure 5:
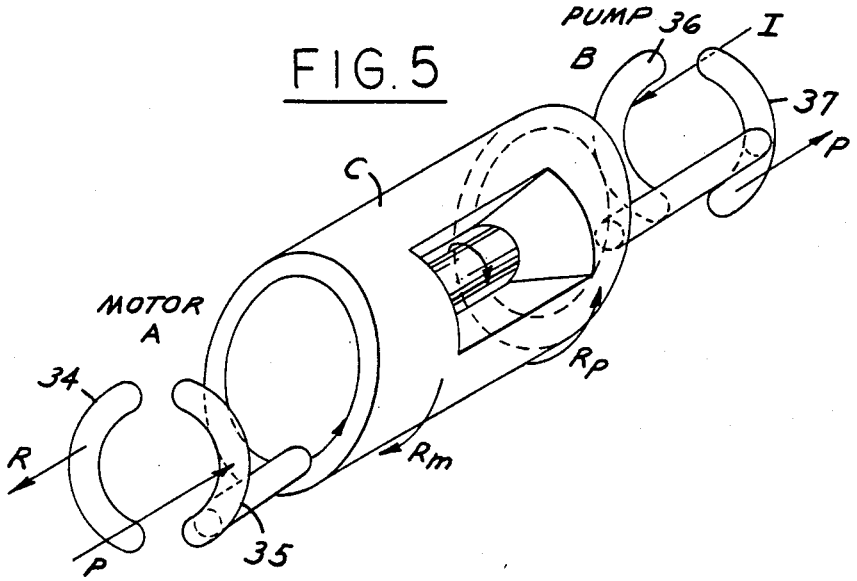

The operation of the power transmission unit can be understood more readily by reference to FIG. 4 wherein it can be seen that when fluid under pressure is supplied to assembly B so that assembly B functions as a motor, the fluid enters passage 37 and is exhausted through passage 36. The pressure of fluid rotates the cam block C causing assembly A to function as a pump drawing fluid through inlet 34 and exhausting the fluid through outlet 35. The cam block rotates due to the frictional action of the shoes against the shoe bearing plate. The angle block rotates to position itself automatically so that the maximum displacement is reached on the motor side and to a position for a displacement regulated by a pin and slot arrangement, as presently described.

Figure 7:
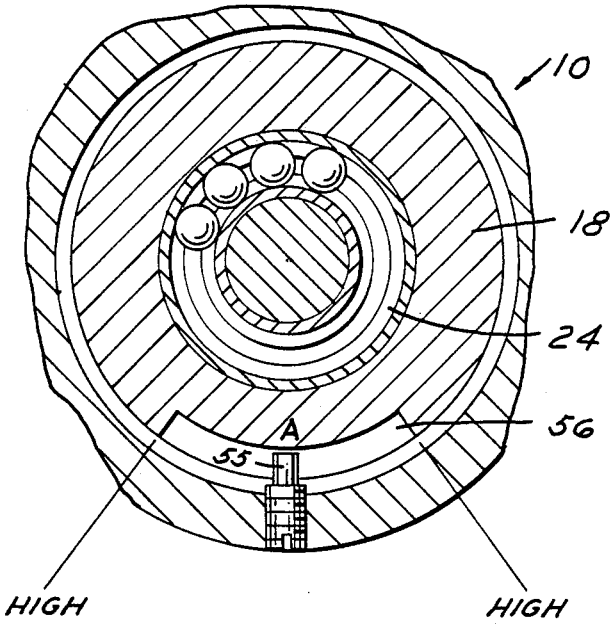
FIG. 7 is a fragmentary sectional view taken along the line 7—7 in FIG. 1.

It is preferred that some provision be provided for limiting the rotation of the cam block as shown, for example, in FIG. 7 wherein a radial pin 55 on the housing extends to an arcuate slot 56 in the cam block so that engagement of the pin 55 with the ends of the slot limits the angular movement.

In addition, it has been found that it is necessary to phase the position of the valve plate 32 with respect to the valve plate 33 in a manner where the arcuate slots 34, 35 are angularly displaced with respect to the arcuate slots 36, 37 in order to provide needed starting torque. In addition, it is necessary that the two parts 18, 19 of cam block C be phased circumferentially relative to one another, that is, one of the inclined surfaces of the cam block being inclined circumferentially relative to the other.

Figure 6:
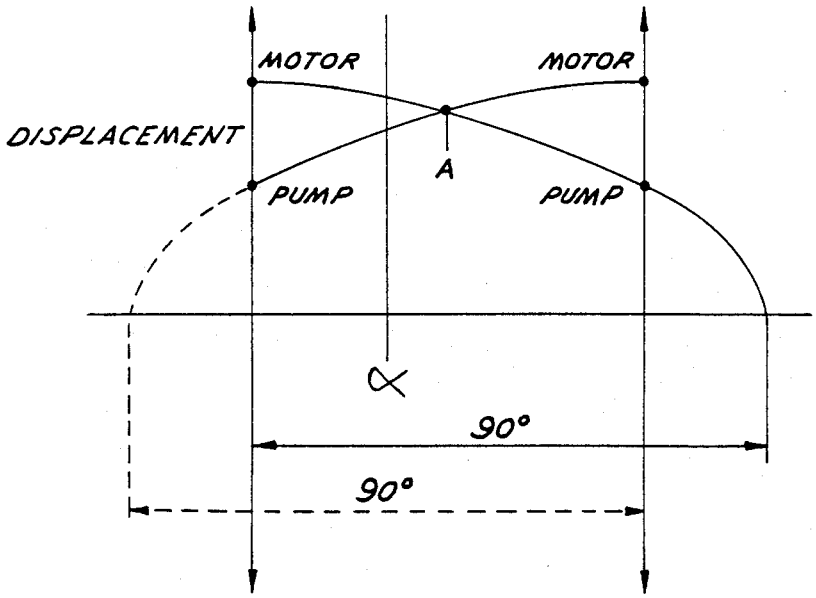
FIG. 6 is a graph of the displacement versus the angle of the cam block of a theoretical unit.

In order to determine the extent of required phasing, FIG. 6 has been provided when the above invention is used as a Power Transfer Unit (PTU) as required in most large aircraft where weight limitations and redundancy impose a limitation in the power that hydraulic circuits are capable of generating, even though at some time the demand of power in a circuit may exceed the generated power in that particular circuit.

The displacement of the unit is a function of the phase angle between the top dead center of the pistons and the top dead center of the angle block. By changing this angle the displacement of the unit (pumping side or motoring side) will vary as a sine or cosine of the angle.

So, when the angle block is rotated from a starting position, on the left side of the diagram, the displacement of the motor being larger than the displacement of the pump, and assuming that the pressures in the two systems are maintained equal, the unit side with the largest displacement will act as a motor and by torque transmission will power the pump to pump fluid in the second system. As the angle changes to an angle Alpha ($\alpha$), it can be seen that the motor displacement has been reduced and that the pump displacement has been increased, thus providing a better match of the secondary system. As the displacement of the angle block increases, a point A will be reached where the displacements of the two units are equal, thus providing an equilibrium where no transfer of power occurs to one system from the other system. This condition is desirable since the position can be used in a standby mode awaiting a demand to transfer in either direction.

As the angle is increased beyond point A the curves having crossed over, the process reverses whereby the former pumping element becomes a motor and the former motor unit becomes a pumping unit. Also as can be seen from the diagram, the total angular displacement of the unit can be less than 90 degrees since there is no reason to have the motor at full displacement if the pump is at zero displacement, since to power transmission would occur. This explains the limited overlap of the two curves and the discarded portion outside the boundary of the maximum angular displacement of the unit. Another point of importance is that as configured by the diagram, full use is made of the displacement of the motor to obtain maximum starting torque and minimum required pump torque and that adaptation of the transmitted torque can be done by increasing the angle Alpha.

Thus, the unit has many advantages. This unit has a very minimum of parts. Both sets of parts are interchangeable. The power transfer unit is totally reversible. All generated and reactive forces are contained in the unit.

A large number of control types can be applied to the unit, the control system can be made extremely small since the internal forces are balanced by design, thus simplifying the control which can be mechanical, hydraulic, electrical, manual or any combination of these.

Electric control can be adapted to the unit with sensors for parameters such as pressure, speed, and the like.

The power transfer unit can be placed in stand-by condition at the center position where immediate response can be made upon demand to either system.

What is claimed is:

1. A reversible power transmission unit comprising a housing, a cam block, means rotatably mounting said cam block in said housing, said cam block having opposed inclined surfaces which are inclined circumferentially relative to one another, a pumping mechanism associated with each of said opposed inclined surfaces of the cam block, a common shaft rotatably mounted in said cam block and having its ends extending beyond the cam block, each pumping mechanism including a cylinder barrel coupled to said shaft for rotation with said shaft and having a plurality of cylinders with pistons slidable therein and operatively associated with a surface of the cam block, a valve plate associated with each barrel, inlet and outlet openings at each end of said housing, each cylinder barrel having a port opening to its respective valve plate provided with inlet and outlet ports in communication with said inlet and outlet passages at each end of the housing, one of said pumping mechanisms having a greater flow capacity than the other of said pumping mechanisms, means on said housing for limiting rotation of said cam block between preselected angularly spaced limits relative to said housing, said cam block being freely rotatable within said housing between said limits, such that when fluid pressure is applied to said one of the pumping mechanisms having the greater flow capacity, said one mechanism functions as a motor and the pressure of fluid rotates said cam block toward one of said limits corresponding to maximum displacement of said one mechanism and causes said other pumping mechanism to function as a pump.

2. The power transmission unit set forth in claim 1 wherein said valve plates are circumferentially displaced relative to one another whereby said arcuate inlet and outlet passages in said plate are non-aligned.

* * * * *